US010658765B2

(12) United States Patent
Chavali et al.

(10) Patent No.: US 10,658,765 B2
(45) Date of Patent: May 19, 2020

(54) EDGE-FIRING ANTENNA WALLS BUILT INTO SUBSTRATE

(71) Applicant: Intel Corporation, Santa Clara, CA (US)

(72) Inventors: Sri Chaitra Jyotsna Chavali, Chandler, AZ (US); Sanka Ganesan, Chandler, AZ (US); William J. Lambert, Chandler, AZ (US); Debendra Mallik, Chandler, AZ (US); Zhichao Zhang, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 1 day.

(21) Appl. No.: 16/021,474

(22) Filed: Jun. 28, 2018

(65) Prior Publication Data

US 2020/0006866 A1 Jan. 2, 2020

(51) Int. Cl.

| | |
|---|---|
| ***H01Q 1/38*** | (2006.01) |
| ***H01Q 25/00*** | (2006.01) |
| ***H01Q 9/04*** | (2006.01) |

(52) U.S. Cl.

CPC ..... *H01Q 25/00* (2013.01); *H01Q 1/38* (2013.01); *H01Q 9/0407* (2013.01)

(58) Field of Classification Search

CPC ..... H01Q 25/00; H01Q 1/38; H01Q 9/0407
See application file for complete search history.

(56) References Cited

U.S. PATENT DOCUMENTS

| | | | | |
|---|---|---|---|---|
| 8,368,595 | B2 * | 2/2013 | Lee | H01Q 1/40 343/700 MS |
| 9,912,056 | B2 * | 3/2018 | Noda | H01Q 21/28 |
| 10,263,332 | B2 * | 4/2019 | Yong | H01Q 3/34 |
| 10,347,598 | B2 * | 7/2019 | Baek | H01L 23/66 |
| 10,381,729 | B2 * | 8/2019 | Shirai | H01Q 7/005 |

* cited by examiner

*Primary Examiner* — Brian K Young
(74) *Attorney, Agent, or Firm* — Schwegman Lundberg & Woessner, P.A.

(57) ABSTRACT

A method of forming a planar antenna on a first substrate. An antenna feedline is formed on a peelable copper film of a carrier. A dielectric with no internal conductive layer is formed on the feedline. A planar antenna is formed on one of two parallel sides of the dielectric and a feed port is formed adjacent the other parallel side. The feedline connects the antenna with the feed port. One plane of the planar antenna is configured for perpendicular attachment to a second substrate. The feedline is connected to the planar antenna by a via through the dielectric. The peelable copper is removed and the structure is etched to produce the planar antenna on the substrate. Two planar antennas on substrates can be perpendicularly attached to another substrate to form side-firing antennas.

32 Claims, 8 Drawing Sheets

EDGE-FIRING ANTENNA WALLS BUILT INTO SUBSTRATE

TECHNICAL FIELD

The disclosure herein relates edge-fire antennas that conserve XY form factor area in a wireless circuit board package.

5G millimeter wave (mmWave) technology needs package architecture advances in order to keep the overall mobile device package form factor low and performance high. Especially in the client and Internet of Things (IoT) segment, where package XY area limitations exist, there is need for antennas to fire signals from the edge of the package from the z-height of the package, rather than from the XY area of the package. This is because, among other things, other components typically are located in the XY dimension and this limits XY area availability. Such components are active, so they also cause electromagnetic interference (EMI) that requires shielding for the antenna, which is expensive. For the server segment, where there is point to point communication which is performed using cables, a side-firing antenna architecture would be beneficial to server data centers where high performance is key and efficient thermal path solutions are needed. Therefore a need exists for edge-fire, or side-fire, antennas that minimize need for XY area usage.

BRIEF DESCRIPTION OF THE DRAWINGS

FIG. 2A illustrates a first photoresist area on the copper foil of an incoming core carrier and a copper plating step after exposure of the first photoresist, according to some embodiments.

FIG. 2B illustrates a second photoresist area, and a copper plating step after exposure of the second photoresist, according to some embodiments.

FIG. 2C illustrates lamination of a dielectric layer and a third photo resist, according to some embodiments.

FIG. 2D illustrates copper plating features of an antenna after exposure of the third photoresist, according to some embodiments.

FIG. 2E illustrates stripping the third photoresist away, according to some embodiments.

FIG. 2F illustrates removal of the antenna structure from the peelable core, according to some embodiments.

FIG. 2G illustrates a flash etch of the bottom of the antenna structure, according to some embodiments.

FIG. 2H illustrates a completed antenna on a substrate, according to some embodiments.

FIG. 3A illustrates a top view of a bow tie antenna with the feed port in-line with the antenna wings, according to some embodiments.

FIG. 3B illustrates a top view of a bow tie antenna with the wings at ninety degrees to the feed port, according to some embodiments.

FIG. 3C illustrates the antennas of FIGS. 3A and 3B standing perpendicular to, and attached to, a substrate, according to some embodiments.

FIG. 3D illustrates a perspective view of a patch antenna made according to the described process, according to some embodiments.

FIG. 3E is a front view of a patch antenna made according to the described process, according to some embodiments.

FIG. 3F is a back view of a patch antenna made according to the described process, according to some embodiments.

DETAILED DESCRIPTION

Z-mounted side-firing antennas can be created as copper walls by copper plating on a substrate or as a pin-shooting of copper walls on a substrate, similar to creating discrete components on top of a substrate or similar to creating embedded components towards the walls of a substrate.

Figure 1:
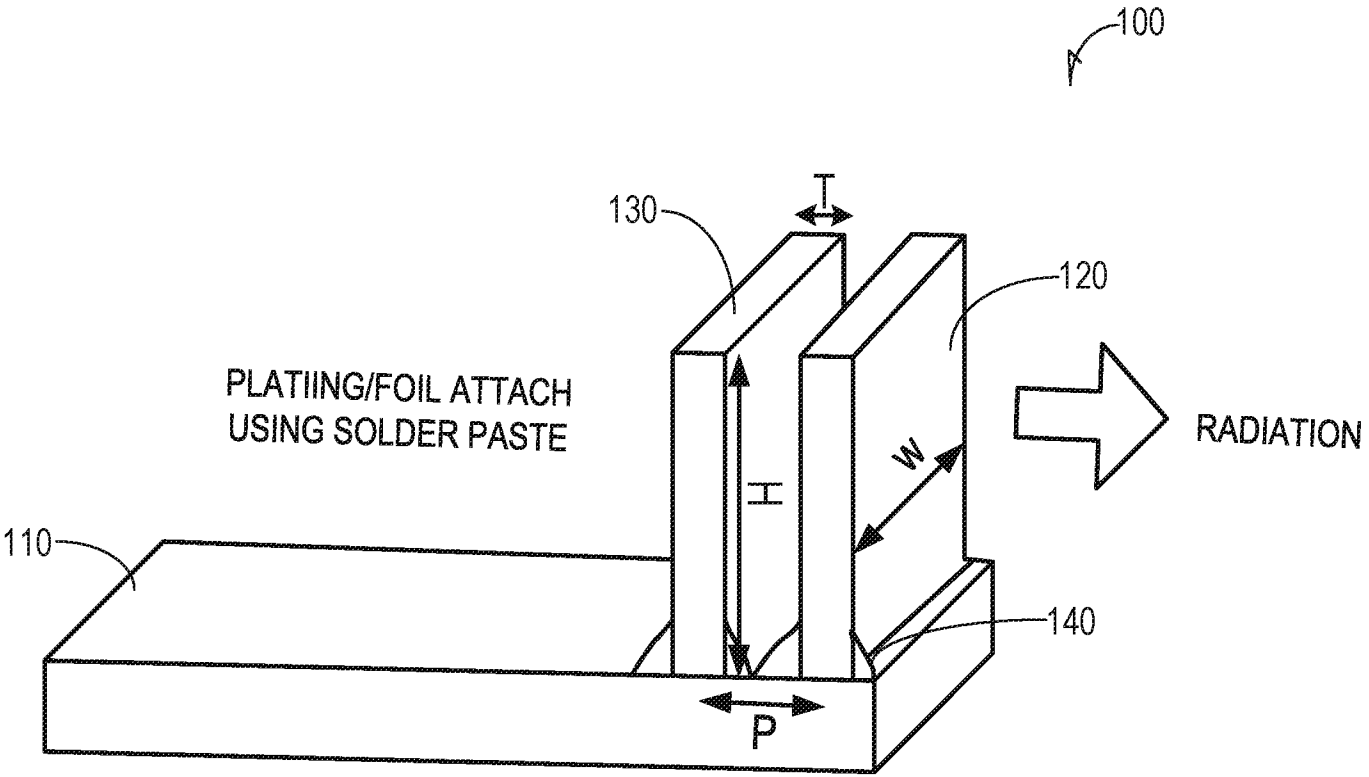
FIG. 1 is a schematic of a side-firing Z-mounted substrate on substrate antenna architecture, according to some embodiments.

FIG. 1 is a schematic of a side Z-mounted substrate-on-substrate antenna architecture 100, according to some embodiments. The substrate 110 is the bottom substrate of the substrate-on-substrate architecture 100, with copper pillar 120, 130 either plated or mounted as at 140, similar to how discrete capacitors or an individual substrate can be attached in the Z direction on a substrate by solder. One can define the architecture as a side or Z-mounted substrate-on-substrate architecture. Pillar 120, which may be a mountable antenna as disclosed herein, in some embodiments, can also be a substrate in itself, which is patterned into an antenna design with radiation in the direction of the arrow. Element, or substrate, 130 can function to shield the antenna from EMI caused by radio frequency front ends (RFFEs).

FIGS. 2A-2H illustrate a process 200 for creating a side-firing Z-mounted antenna substrate on another substrate, according to some embodiments. A process flow and schematic of such a substrate is described below to form an antenna. In some embodiments the antenna is illustrated as a bow tie antenna as discussed with respect to FIGS. 3A-3C. However, the disclosed subject matter is not limited to a bow tie antenna. Any type of planar antenna can be created by varying the photoresist and copper plating steps below to be an antenna other than the described bow tie antenna. For example, in another embodiment, a patch antenna can be designed. The process steps remain essentially the same as described below for the bow-tie antenna embodiment, but a different type of antenna is created. An embodiment illustrating a patch antenna is discussed with respect to FIGS. 3D-3F, below. The vias created in the process can be by photolithography or laser defined, and there is essentially no restriction on the type of metal used for designing any part of the antenna structure as long as it is amenable to a substrate manufacturing line, in some embodiments. A process of attaching the vertical substrate (also referred to as a perpendicular substrate) to a base substrate will be described. As discussed below, the vertical antenna wall can be plated during substrate manufacturing and the vertical antenna substrate can be attached to the base substrate using solder.

Figure 2A:
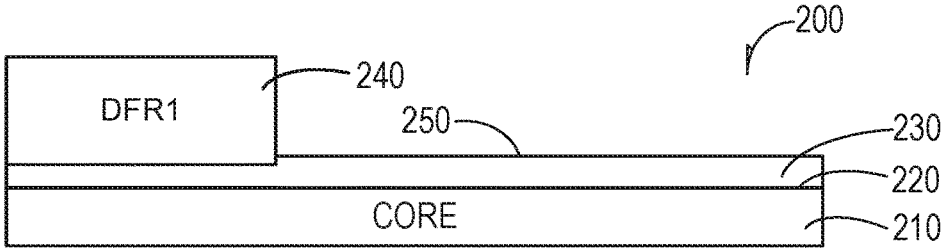
FIGS. 2A-2H illustrate a process for creating a side-firing Z-mounted antenna substrate on another substrate, according to some embodiments.

FIG. 2A illustrates a first photoresist area 240 on the copper foil 230 of an incoming core carrier 210, and a copper plating step 250 after the exposure of the first photoresist, according to some embodiments. The process steps will be carried out on and above the incoming copper foil/carrier. Adhesive layer 220 causes attachment of the copper foil to the core carrier. A first photoresist, which may be dry photoresist in some embodiments, may be laminated on the copper foil 230, the first photo resist may be exposed leaving DFR1 as at 240 and copper pad 250 may be plated on the copper foil 230, according to some embodiments. The first photoresist may be stripped off after the copper plating step. Copper pad 250 will ultimately be the feedline for the antenna and will be integral with the feed port 260A discussed below. However, the disclosed subject matter is not limited to the feedline being integral with the feed port.

Figure 2B:
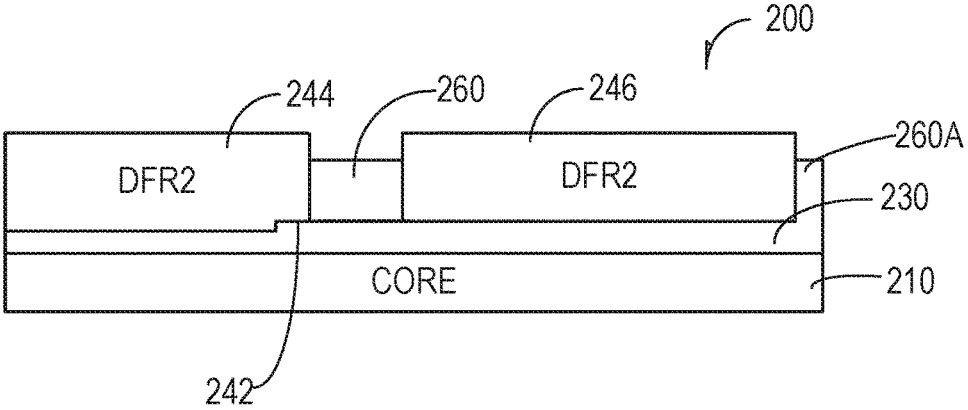

FIG. 2B illustrates a second photoresist area, and a copper plating step after exposure of the second photoresist, according to some embodiments. A second photoresist may be laminated on the copper foil 230 and also on the pad as at 242 and exposed leaving DFR2 as at 244, 246 with accuracy to enable a copper plating of via 260 which will ultimately be a center part of, or positive and negative terminals for, the "wings" of the bow tie antenna, according to some embodiments. Element 260A, which will ultimately be the feed port of the antenna, may also be plated at this time.

Figure 2C:
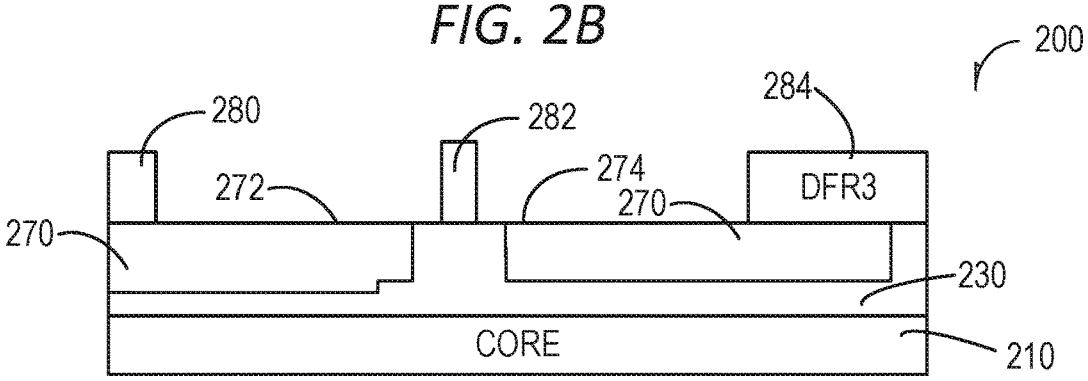

FIG. 2C illustrates lamination of a dielectric layer and a third photo resist, according to some embodiments. Dielectric layer 270 is laminated onto the structure that was formed in FIGS. 2A and 2B and creates a flat surface 272, 274 on which copper plating can be performed. The dielectric will remain with the antenna and will form a substrate for the antenna as part of the ultimate pillar-like substrate-on-substrate package.

Figure 2D:
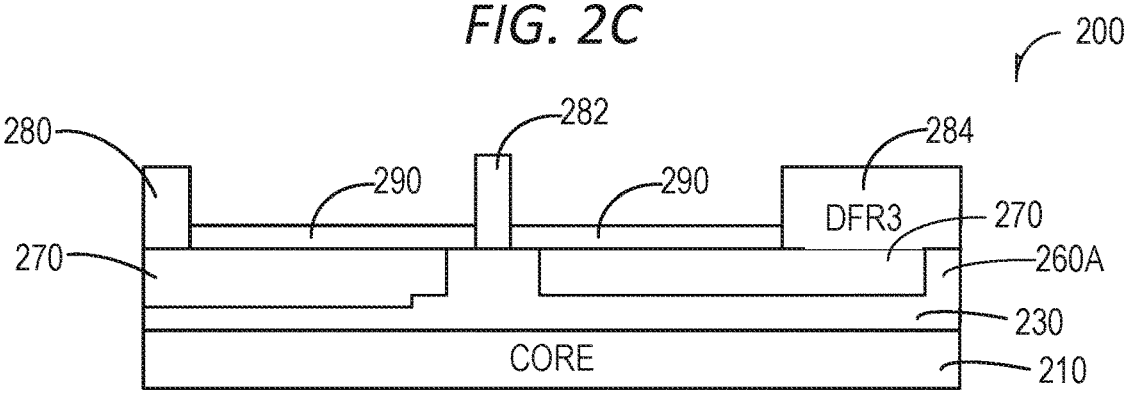

FIG. 2D illustrates copper plating features of an antenna with respect to the second photoresist, according to some embodiments. The third photoresist may be laminated and exposed as at 280, 282, 284. Copper may be plated onto the flat surface provided by dielectric 270, according to some embodiments. At FIG. 2D in the embodiment under discussion, elements 290, which will ultimately the wings of the bow tie antenna may be plated onto dielectric 270. Further, the feed port for the antenna is present at 260A. However, as discussed above, the disclosed subject matter is not limited to a bow tie antenna. Any planar antenna can be constructed by plating the planar parts if the antenna, based on the preferred shape of the antenna being constructed, onto the flat surface 272, 274 as was done for a bow tie antenna in FIG. 2D.

Figure 2E:
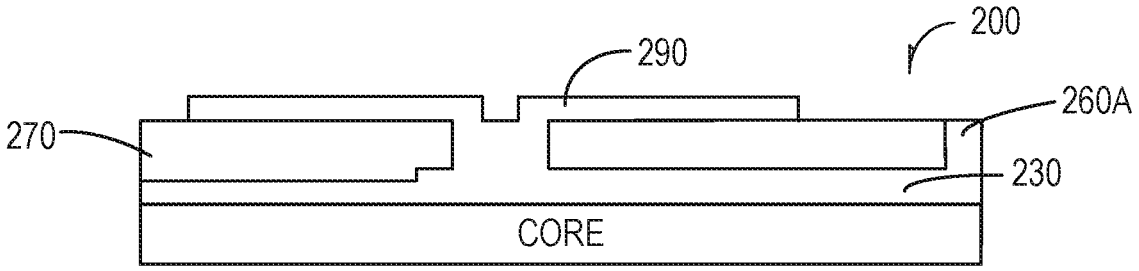
Figure 2F:
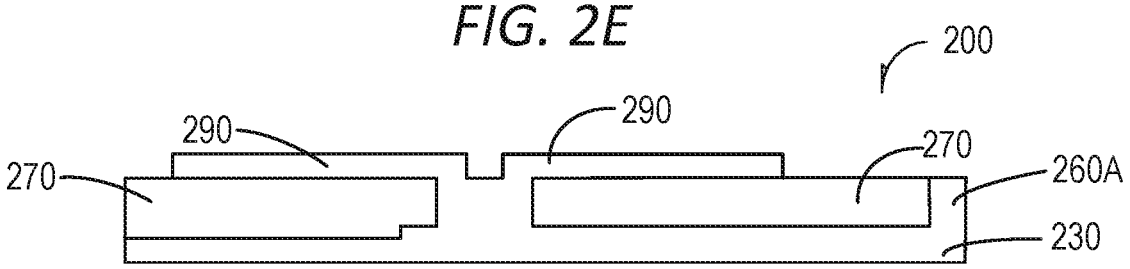

FIG. 2E illustrates stripping the third photoresist away, according to some embodiments. FIG. 2F illustrates removal of the antenna structure from the peelable core, according to some embodiments, leaving copper foil 230 with the antenna and the dielectric 270 attached thereto.

Figure 2G:
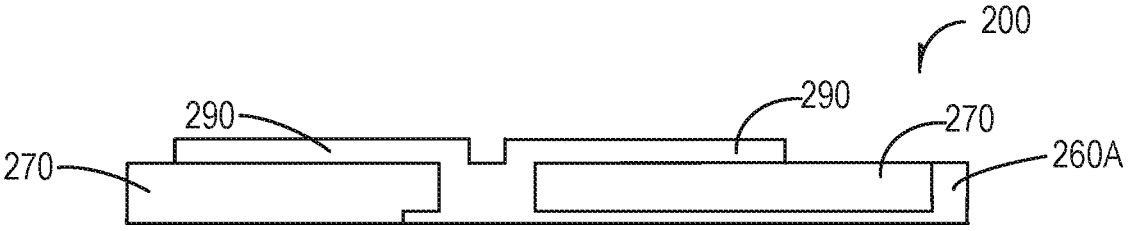

FIG. 2G illustrates a flash etch of the bottom of the antenna structure, according to some embodiments. The top components of the antenna, such as wings 290 should be shielded to protect them from the etching process. The etching step produces the completed antenna structure.

Figure 2H:
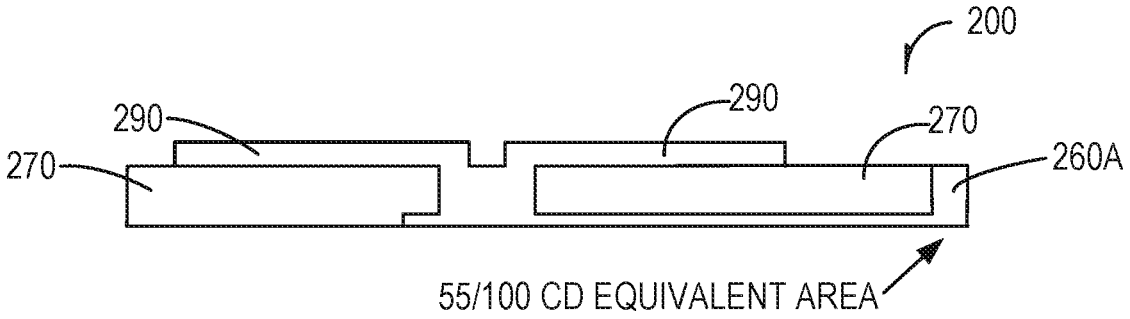

FIG. 2H illustrates a completed antenna on a substrate, according to some embodiments. The antenna, with dielectric backing 270, will be rotated ninety degrees from its position in FIG. 2H to a vertical position and will be connected to a horizontal substrate, usually by solder at feed port 260A. As indicated in FIG. 2H, the area of the solder connection is a critical dimension (CD) of the design. In some embodiments the CD may be a standard 55 um or 100 um, but can be any area ($\pi r^2$ in a rectangular framework) that is appropriate for the design of a particular antenna. In this regard, when attaching the antenna to the substrate, the CD of the area affects the capacitance of the connection, which affects the performance of the antenna. The smaller the connection area, the lower the capacitance. But the smaller the connection area, the less the antenna is supported on the substrate. Consequently, there is a tradeoff in design with respect to the strength of the connection of the antenna to the substrate and the capacitance added by the solder area.

Figures 3A, 3B, 3C:
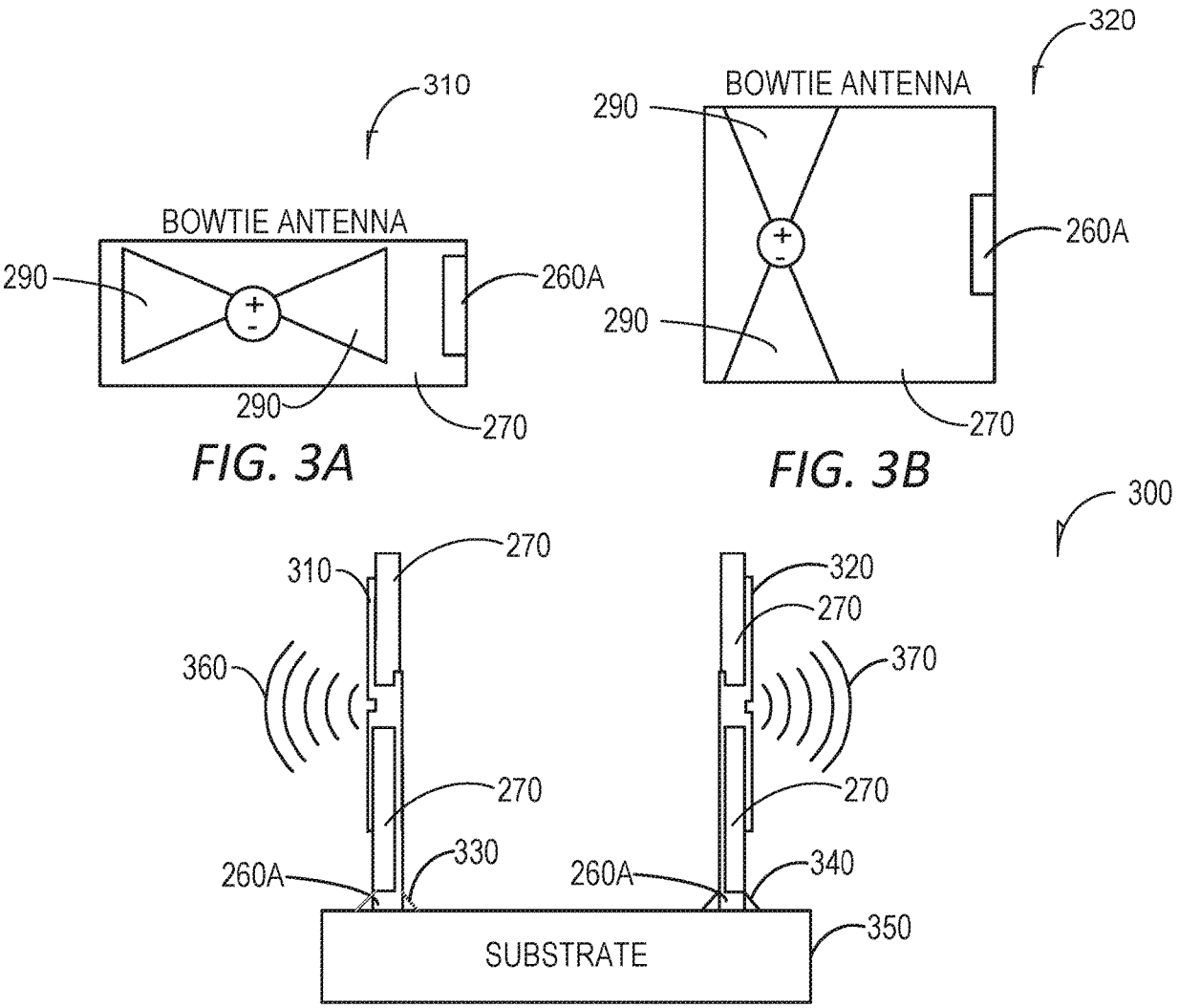
FIGS. 3A-3C illustrate a Z-mounted substrate-on-substrate configuration to create side-firing antenna structures within a circuit board package, according to some embodiments.

FIGS. 3A-3C illustrate a side Z-mounted substrate-on-substrate configuration created as side-firing antenna structures within a package, according to some embodiments.

FIG. 3A is a top view of a bow tie antenna with the feed port in-line with the antenna wings, according to some embodiments. The antenna, supported by 270, is illustrated with wings 290 in-line with feed port 260A. In this configuration, the distance between the wings and the feed port is limited because of the closeness of one wing to the feed port. The embodiments of FIGS. 3A and 3B have their applicability depending on system design and system requirements.

FIG. 3B illustrates a top view of a bow tie antenna with the wings at ninety degrees to the feed port, according to some embodiments. In this configuration, there is more distance between the wings 290 and the feed port 260A.

FIG. 3C illustrates the antennas of FIGS. 3A and 3B standing perpendicular to, and attached to, a substrate, according to some embodiments. The mounted substrates 310, 320 are indicated as solder-connected at their respective feed ports 260A, by solder connection 330, 340 to the top of the base substrate 350 as a substrate-on-substrate assembly, according to some embodiments. As discussed above, the area of the solder connections 330, 340 affects the capacitance. Elements 360, 370 indicate the radiation direction of the antennas.

Figure 3D:
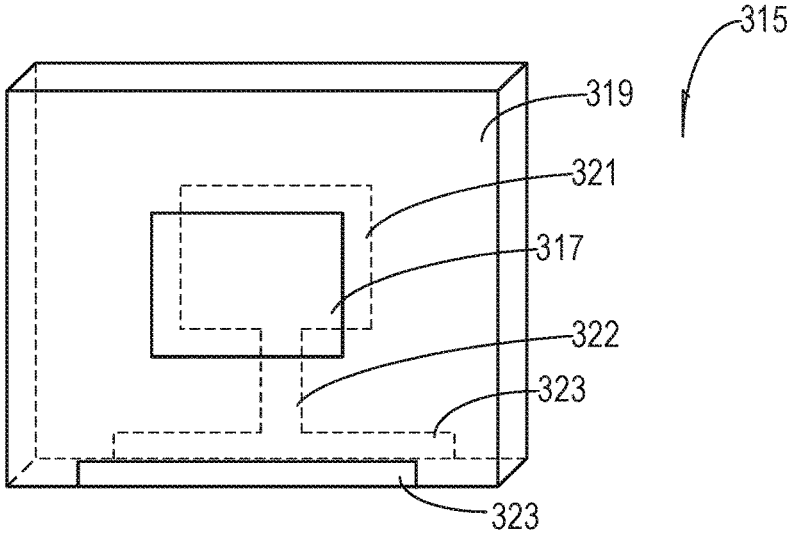
FIGS. 3D-3F illustrate a patch side-firing antenna made according to the described process, according to some embodiments.
Figure 3E:
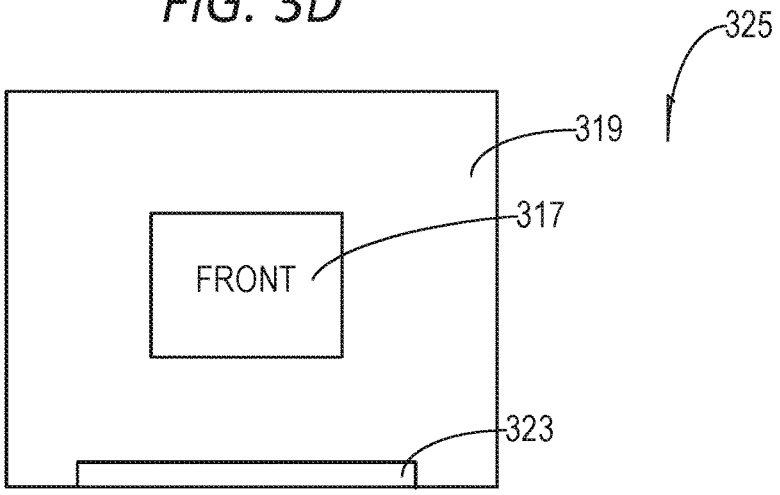
Figure 3F:
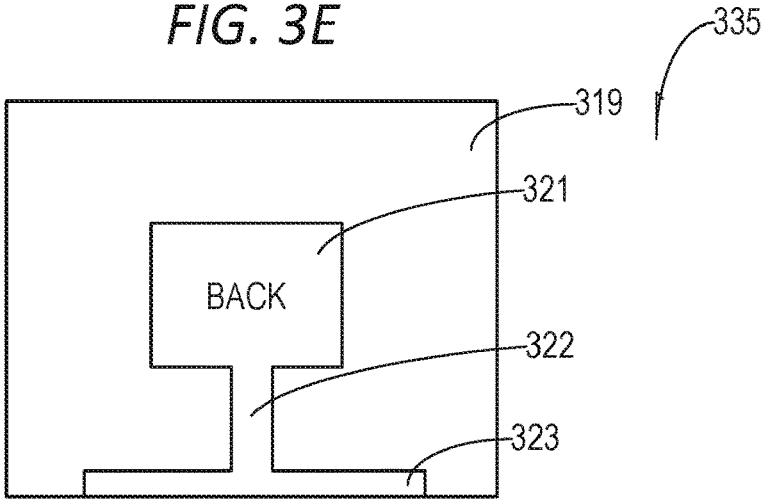

FIGS. 3D-3F illustrate a patch side-firing antenna made according to the described process, according to some embodiments. FIG. 3D illustrates a perspective view of a patch antenna made according to the described process, according to some embodiments. The front side 317 is on a first side of substrate 319 while the back side 321, the feed port 323 and the feed line 322 are on the back a second side of substrate 319. The front side 317, back side 321, feed port 323 and feed line 322 are made according to the process steps discussed above with respect to FIGS. 2A-2H. FIG. 3E is a front view of a patch antenna made according to the described process, according to some embodiments. The front side 317 is seen on the substrate 319, and the feed port is seen at 323, the feed port being located adjacent the dielectric and configured for perpendicular attachment to a second substrate, similarly as was the case with the bow tie antenna that was discussed above. FIG. 3F is a back view of a patch antenna made according to the described process, according to some embodiments. Back side 321 if the patch antenna is illustrated on substrate 391, with feedline 322 connecting the back side 321 to feed port 323. The feed port 323 can be attached perpendicularly to a bottom substrate as was illustrated in FIG. 3C for the bow tie antenna described above.

Figure 4:
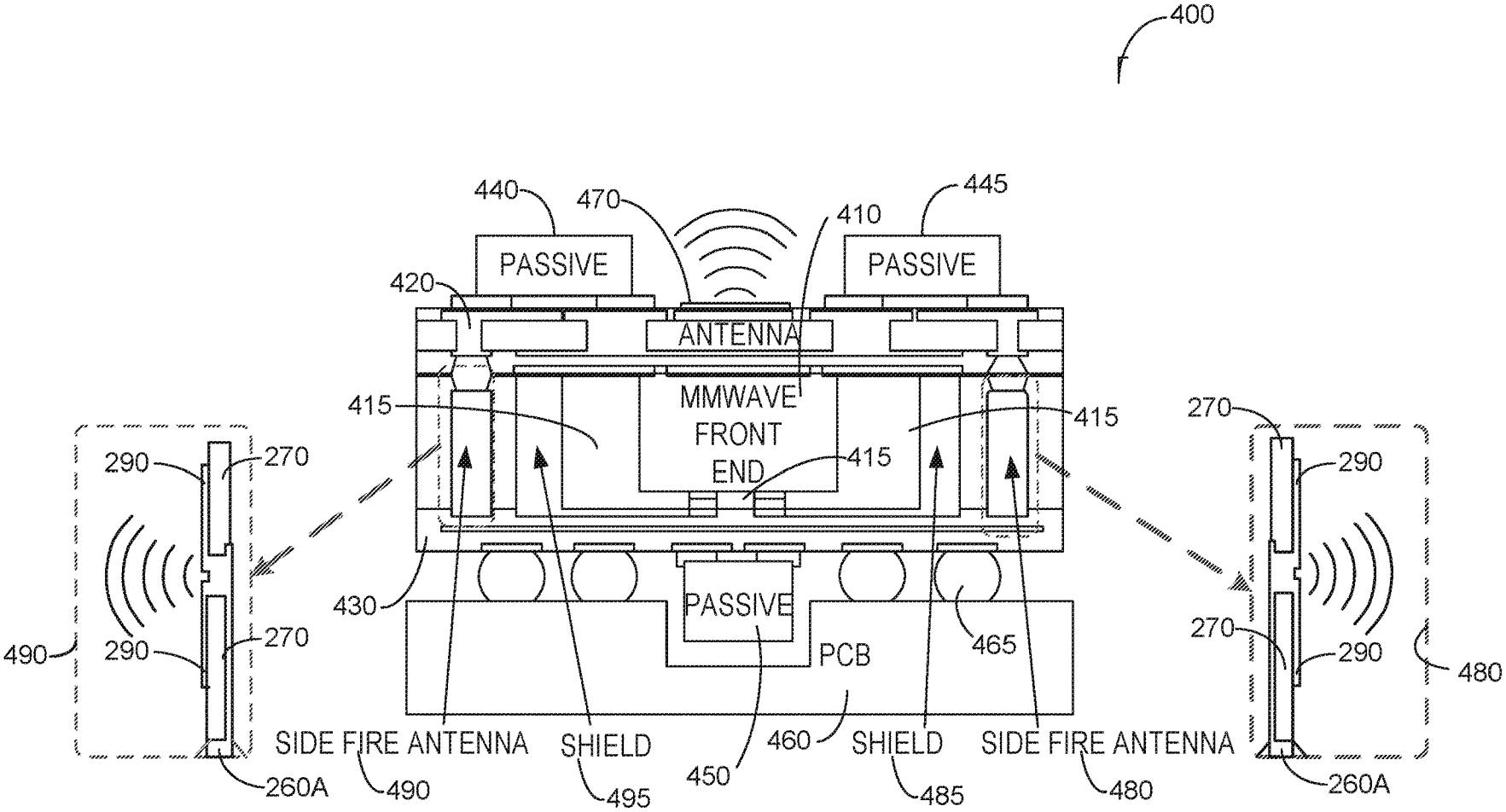
FIG. 4 illustrates a package-on-package architecture with a top-mounted antenna, and edge/side-firing Z-mounted antennas with antenna shields, according to some embodiments.

FIG. 4 illustrates a package-on-package architecture 400 with a top antenna 470, and with Z-mounted edge/side-firing antennas 480, 490 with antenna shields 485, 495 which may also be vertical substrates, according to some embodiments. Side-fire antenna 480 is essentially the antenna illustrated in FIG. 3C which, in some embodiments, is a bow tie antenna with wings 290, feed port 260A and substrate 270. Side-fire antenna 490 may be the same as antenna 480, with wings 290, feed port 260A on substrate 270. A die 410, which in some embodiments may be an mmWave front end, which comprises an RFFE, is sandwiched between two substrates 420, 430. Suitable mold material 415 may be used for strengthening the packages. The bottom substrate 430, in some embodiments, acts as a signal transmission signal line, may have one or more passive components 450 on its bottom plane, and may be connected to the PCB 460 by solder balls 465 or by another suitable connection such as a land grid array. Top substrate 420 has passive components 440, 445, or active dies, along with built-in antenna 470 on its top plane. The package-on-package (PoP) connections comprising side-fire antenna 480, shield 485 and side-fire antenna 490, shield 495 between the two substrates 420, 430 may be built in some embodiments using a wall-like design, which act as side-fire antennas 480, 490 that fire from the edges of the package, as discussed above with respect to the drawings from FIG. 2A through FIG. 3C. The walls 485, 495 can also act as a shield for the side-fire antennas 480, 490 for protection against the EMI from actives such as at least mmWave front end 410, present in the package, according to some embodiments.

In the mobile/IoT spectrum, real estate is an expensive commodity. In most cases, performance is traded off for form factor. The disclosed antenna architecture enables multiple directionality to electrical radiative signals. The disclosed antenna architecture also keeps the XY area form factor nearly the same as without the antenna because the Z-dimension is primarily used for the antenna. This will provide a very substantial advantage to antenna performance due to built-in substrate/package frameworks and reduced XY area of the package, such as in the disclosed subject matter. In the server space, where the communication between package to package is typically done through high frequency wired cables that can be lossy due to connector resistances. Having flexibility in antenna design and exploring radiative form of communication between packages can enable faster modes of information transfer.

Figure 5:
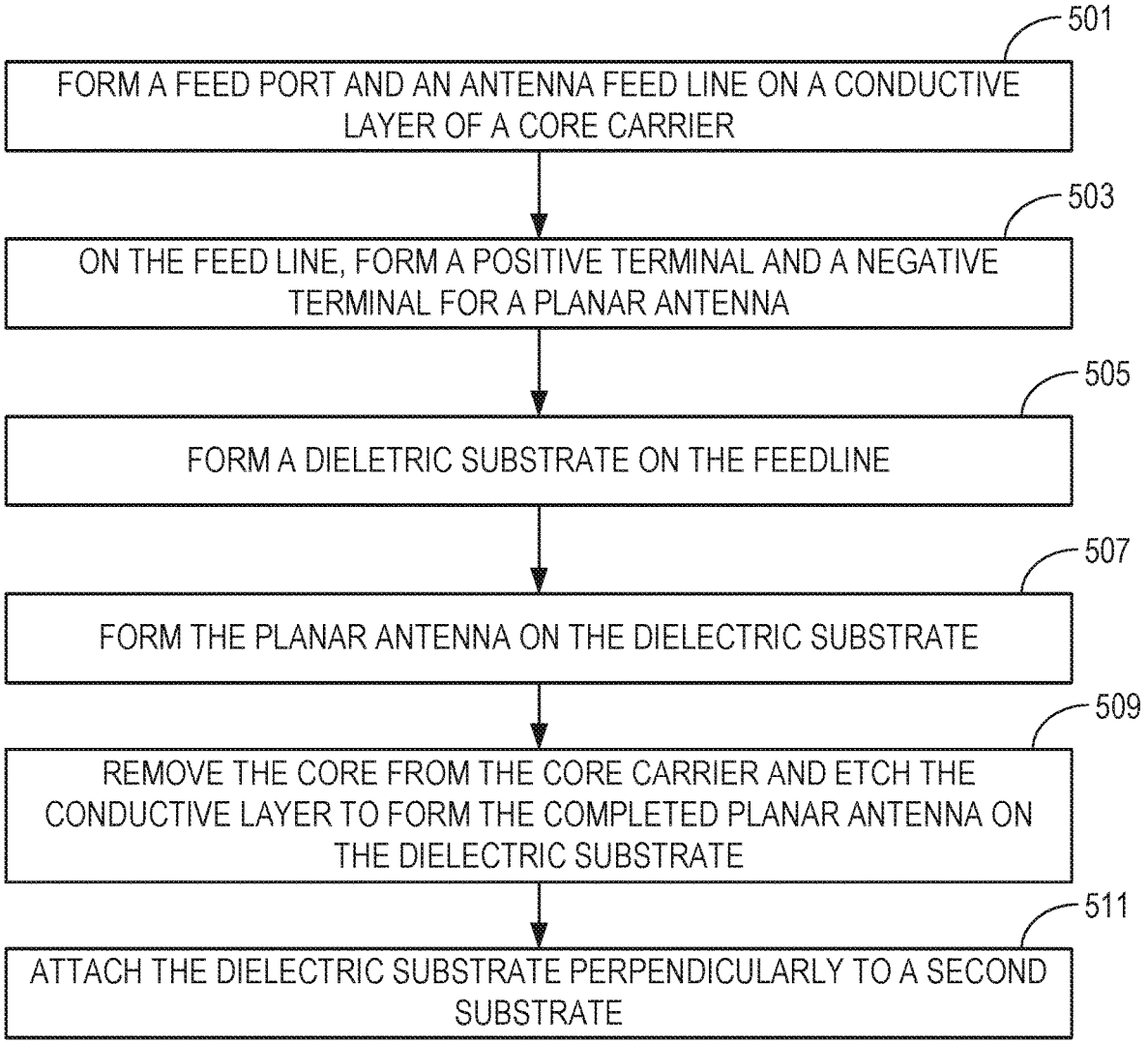
FIG. 5 is a flow chart of process steps used for creating side-firing Z-mounted antenna structures within a circuit board package, according to some embodiments.

FIG. 5 is a flow chart of process steps used for creating side-firing Z-mounted antenna structures within a circuit board package, according to some embodiments. At 501 feed port and an antenna feed line are formed on a conductive layer of a core carrier. At 503, a positive terminal and a negative terminal for a planar antenna are formed on the feed line. At 505 a dielectric substrate is formed on the feedline. At 507 the planar antenna elements are formed on the dielectric substrate. At 509 the core from the core carrier is removed and the conductive layer is etched to produce the completed planar antenna on the dielectric substrate. At 511 the dielectric substrate is perpendicularly attached to a second substrate.

Figure 6:
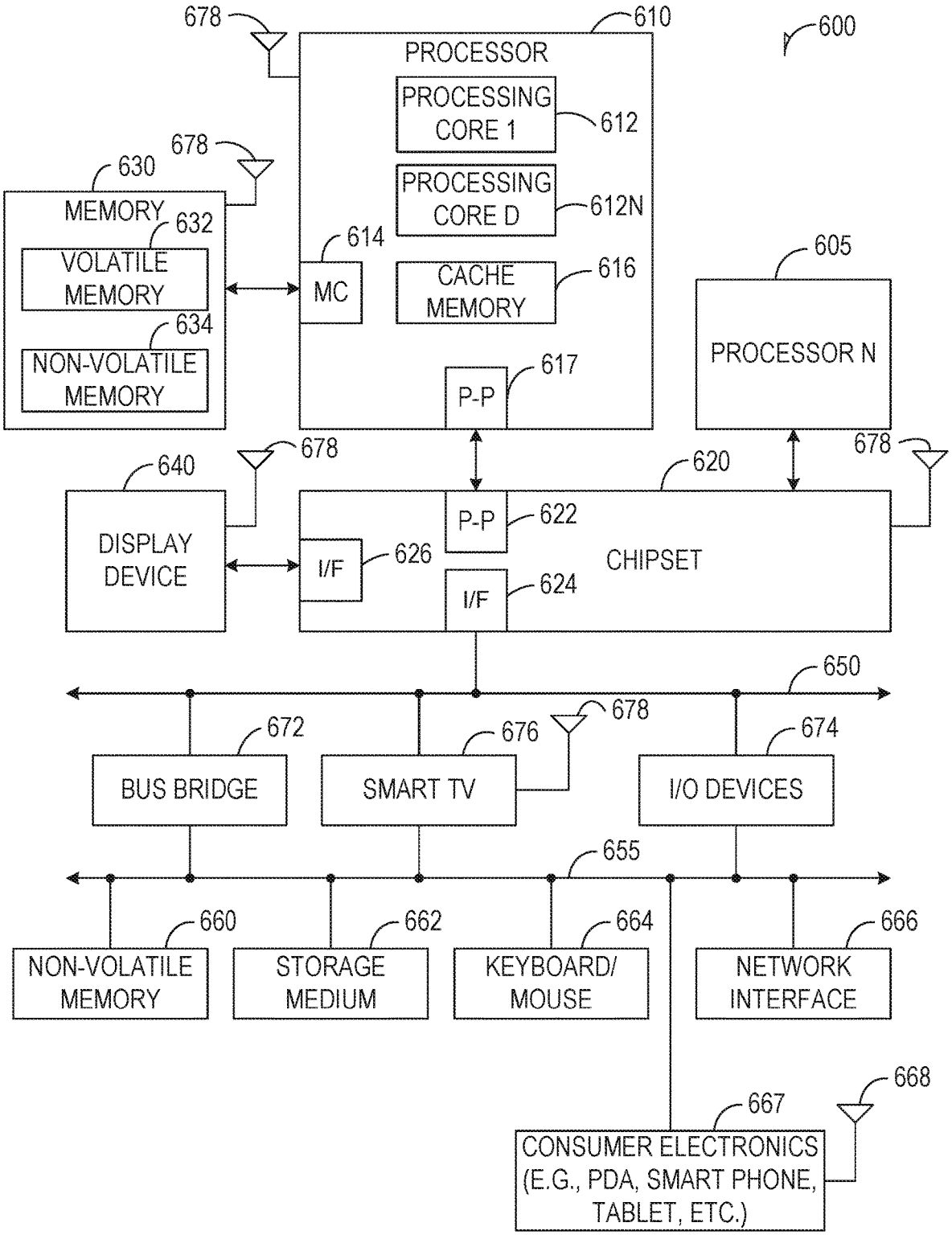
FIG. 6 illustrates an example machine that is capable of using Z-mounted side-firing antennas as disclosed herein, according to some embodiments.

FIG. 6 illustrates a system level diagram, depicting an example of an electronic device (e.g., system) including one or more antenna structures discussed herein. In one embodiment, system 600 includes, but is not limited to, a desktop computer, a laptop computer, a netbook, a tablet, a notebook computer, a personal digital assistant (PDA), a server, a workstation, a cellular telephone, a mobile computing device, a smart phone, an Internet appliance or any other type of computing device. In some embodiments, system 600 is a system on a chip (SOC) system.

In one embodiment, processor 610 has one or more processor cores 612 and 612N, where 612N represents the Nth processor core inside processor 610 where N is a positive integer. In one embodiment, system 600 includes multiple processors including 610 and 605, where processor 605 has logic similar or identical to the logic of processor 610. In some embodiments, processing core 612 includes, but is not limited to, pre-fetch logic to fetch instructions, decode logic to decode the instructions, execution logic to execute instructions and the like. In some embodiments, processor 610 has a cache memory 616 to cache instructions and/or data for system 600. Cache memory 616 may be organized into a hierarchal structure including one or more levels of cache memory.

In some embodiments, processor 610 includes a memory controller 614, which is operable to perform functions that enable the processor 610 to access and communicate with memory 630 that includes a volatile memory 632 and/or a non-volatile memory 634. In some embodiments, processor 610 is coupled with memory 630 and chip set 620. Processor 610 may also be coupled to a wireless antenna 678 to communicate with any device configured to transmit and/or receive wireless signals. In one embodiment, an interface for wireless antenna 678 operates in accordance with, but is not limited to, the IEEE 802.11 standard and its related family, Home Plug AV (HPAV), Ultra Wide Band (UWB), Bluetooth, WiMax, or any form of wireless communication protocol.

In some embodiments, volatile memory 632 includes, but is not limited to, Synchronous Dynamic Random Access Memory (SDRAM), Dynamic Random Access Memory (DRAM), RAM BUS Dynamic Random Access Memory (RDRAM), and/or any other type of random access memory device. Non-volatile memory 634 includes, but is not limited to, flash memory, phase change memory (PCM), read-only memory (ROM), electrically erasable programmable read-only memory (EEPROM), or any other type of non-volatile memory device.

Memory 630 stores information and instructions to be executed by processor 610. In one embodiment, memory 630 may also store temporary variables or other intermediate information while processor 610 is executing instructions. In the illustrated embodiment, chip set 620 connects with processor 610 via Point-to-Point (PtP or P-P) interfaces 617 and 622. Chip set 620 enables processor 610 to connect to other elements in system 600. In some embodiments of the example system, interfaces 617 and 622 operate in accordance with a PtP communication protocol such as the Intel® QuickPath Interconnect (QPI) or the like. In other embodiments, a different interconnect may be used.

In some embodiments, chip set 620 is operable to communicate with processor 610, 605N, display device 640, and other devices, including a bus bridge 672, a smart TV 676, I/O devices 674, nonvolatile memory 660, a storage medium (such as one or more mass storage devices) 662, a keyboard/mouse 664, a network interface 666, and various forms of consumer electronics 677 (such as a PDA, smart phone, tablet etc.), etc. In one embodiment, chip set 620 couples with these devices through an interface 624. Chip set 620 may also be coup led to a wireless antenna 678 to communicate with any device configured to transmit and/or receive wireless signals.

Chip set 620 connects to display device 640 via interface 626. Display 640 may be, for example, a liquid crystal display (LCD), a plasma display, cathode ray tube (CRT) display, or any other form of visual display device. In some embodiments of the example system, processor 610 and chip set 620 are merged into a single SOC. In addition, chip set 620 connects to one or more buses 650 and 655 that interconnect various system elements, such as I/O devices 674, nonvolatile memory 660, storage medium 662, a keyboard/mouse 664, and network interface 666. Buses 650 and 655 may be interconnected together via a bus bridge 672.

In one embodiment, mass storage device 662 includes, but is not limited to, a solid state drive, a hard disk drive, a universal serial bus flash memory drive, or any other form of computer data storage medium. In one embodiment, network interface 666 is implemented by any type of well-known network interface standard including, but not limited to, an Ethernet interface, a universal serial bus (USB) interface, a Peripheral Component Interconnect (PCI) Express interface, a wireless interface and/or any other suitable type of interface. In one embodiment, the wireless interface operates in accordance with, but is not limited to, the IEEE 802.11 standard and its related family, Home Plug AV (HPAV), Ultra Wide Band (UWB), Bluetooth, WiMax, or any form of wireless communication protocol.

While the modules shown in FIG. 6 are depicted as separate blocks within the system 600, the functions performed by some of these blocks may be integrated within a single semiconductor circuit or may be implemented using two or more separate integrated circuits. For example, although cache memory 616 is depicted as a separate block within processor 610, cache memory 616 (or selected embodiments of 616) can be incorporated into processor core 612.

Examples, as described herein, may include, or may operate on, logic or a number of components, modules, or mechanisms. Modules are tangible entities (e.g., hardware) capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine readable medium. In an example, the software, when executed by the underlying hardware of the module, causes the hardware to perform the specified operations.

Accordingly, the term "module" is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comp rise a general-purpose hardware processor configured using software, the general-purpose hardware processor may be configured as respective different modules at different times. Software may accordingly configure a hardware processor, for example, to constitute a particular module at one instance of time and to constitute a different module at a different instance of time.

EXAMPLES

Example 1 is a planar antenna comprising: a first substrate comprising a dielectric having two parallel sides; a planar antenna formed on a first of the two parallel sides of the dielectric; and a feed port for the antenna, the feed port located adjacent the dielectric, wherein a plane of the planar antenna is configured for perpendicular attachment to a second substrate.

In Example 2, the subject matter of Example 1 optionally includes a feedline on a second of the two parallel sides of the dielectric, the feedline integral with the feed port.

In Example 3, the subject matter of any one or more of Examples 1-2 optionally include wherein the feed port includes a first part perpendicular to the planar antenna.

In Example 4, the subject matter of any one or more of Examples 1-3 optionally include wherein the feed port is located perpendicular to the two parallel sides of the dielectric.

In Example 5, the subject matter of any one or more of Examples 2-4 optionally include a positive terminal and a negative terminal for the planar antenna, wherein the positive terminal and the negative terminal are connected to the feedline by a via.

In Example 6, the subject matter of any one or more of Examples 2-5 optionally include wherein the feedline is plated on a copper film, the copper film comprising part of a core carrier.

In Example 7, the subject matter of any one or more of Examples 1-6 optionally include wherein the dielectric substrate has no interior conductive layer parallel to the two parallel sides.

Example 8 is a substrate-on-substrate planar antenna system comprising: a first substrate comprising a planar antenna, the first substrate configured to be attached perpendicularly to a second substrate; and a second substrate connected perpendicularly to the first substrate.

In Example 9, the subject matter of Example 8 optionally includes wherein: the first substrate comprises a dielectric having two parallel sides; the planar antenna is located on a first of the two parallel sides of the dielectric; a feed port for the antenna is located adjacent the dielectric; and a feedline from the feed port is located on a second of the two parallel sides of the dielectric.

In Example 10, the subject matter of Example 9 optionally includes wherein the feed port is integral with the feed line and is located perpendicular to the first of the two parallel sides of the dielectric.

In Example 11, the subject matter of any one or more of Examples 9-10 optionally include a positive terminal and a negative terminal for the planar antenna, wherein the positive terminal and the negative terminal are connected to the feedline by a via.

In Example 12, the subject matter of any one or more of Examples 9-11 optionally include wherein the feedline is plated on a copper film, the copper film comprising part of a core carrier.

In Example 13, the subject matter of any one or more of Examples 8-12 optionally include wherein the second substrate has no interior conductive layer parallel to the two parallel sides.

Example 14 is a package-on-package planar antenna system comprising: a first substrate that includes a first passive computer processor component or a first active computer processor component; a second substrate that includes a second passive computer processor component or a second active computer processor component, the second substrate parallel to the first substrate; a radio frequency front end (RFFE) located between the first substrate and the second substrate; and a plurality of substrate-on-substrate planar antenna systems connected perpendicularly to the first substrate and to the second substrate.

In Example 15, the subject matter of Example 14 optionally includes wherein at least one of the plurality of substrate-on-substrate planar antenna systems comprises: a third substrate connected perpendicularly to the first substrate, the third substrate comprising a planar antenna; and a fourth substrate connected perpendicularly to the second substrate, the fourth substrate configured to shield the planar antenna from electromagnetic interference (EMI) caused by the RFFE.

In Example 16, the subject matter of Example 15 optionally includes wherein, the third substrate comprises a dielectric having two parallel sides; the planar antenna is located on a first of the two parallel sides of the dielectric; a feed port for the antenna is located adjacent the dielectric; and a feedline from the feed port is located on a second of the two parallel sides of the dielectric.

In Example 17, the subject matter of Example 16 optionally includes wherein the planar antenna is attached to and located perpendicular to each of the first substrate and the second substrate.

In Example 18, the subject matter of any one or more of Examples 16-17 optionally include a positive terminal and a negative terminal for the planar antenna, wherein the positive terminal and the negative terminal are connected to the feedline.

In Example 19, the subject matter of any one or more of Examples 16-18 optionally include wherein the feedline is plated on a copper film, the copper film comprising part of a core carrier.

In Example 20, the subject matter of any one or more of Examples 16-19 optionally include wherein the third substrate has no interior conductive layer parallel to the two parallel sides.

Example 21 is a method of forming a planar antenna on a first substrate comprising forming an antenna feedline on a conductive layer of a carrier; forming a dielectric on the conductive layer, the dielectric having two parallel sides; forming a planar antenna on a first of the two parallel sides of the dielectric; and forming a feed port adjacent the dielectric, wherein a plane of the planar antenna is configured for perpendicular attachment to a second substrate and the feed port is connected to the planar antenna by the feedline.

In Example 22, the subject matter of Example 21 optionally includes wherein the dielectric is a singe layer of dielectric.

In Example 23, the subject matter of any one or more of Examples 21-22 optionally include wherein the antenna feedline is connected to the planar antenna by a via through solely the dielectric.

In Example 24, the subject matter of any one or more of Examples 21-23 optionally include wherein one side of the feed port is located perpendicular to the two parallel sides of the dielectric.

In Example 25, the subject matter of any one or more of Examples 23-24 optionally include forming a positive terminal and a negative terminal for the planar antenna, wherein the positive terminal and the negative terminal comprise the via.

In Example 26, the subject matter of any one or more of Examples 21-25 optionally include wherein forming the feedline on a first conductive layer and forming the planar antenna on the dielectric are performed using a photolithographic process.

In Example 27, the subject matter of any one or more of Examples 21-26 optionally include wherein the dielectric has no interior conductive layer parallel to the two parallel sides.

In Example 28, the subject matter of any one or more of Examples 21-27 optionally include wherein the carrier comprises a core that is removable from the conductive layer, the method further comprising removing the core from the conductive layer.

In Example 29, the subject matter of Example 28 optionally includes etching the conductive layer to produce the first substrate.

Example 30 is a method of forming a substrate-on-substrate antenna system, comprising: forming a first substrate comprising a planar antenna formed on a dielectric, the first substrate configured for perpendicular attachment to a second substrate; and attaching the first substrate to the second substrate in a perpendicular configuration.

In Example 31, the subject matter of Example 30 optionally includes forming an antenna feedline on a conductive layer of a carrier, the carrier comprising part of a core that is removable from the conductive layer; forming a dielectric on the feedline, the dielectric having two parallel sides; forming a planar antenna on a first of the two parallel sides of the dielectric; forming a feed port adjacent the dielectric, wherein a plane of the planar antenna is configured for perpendicular attachment to the second substrate and the feed port is connected to the planar antenna by the feedline; removing the core from the conductive layer; and etching the conductive layer to produce the first substrate.

Example 32 is a computer processor comprising: one or more processor cores; memory; and a memory controller, wherein the one or more of the processor cores, memory, or memory controller includes: a substrate-on-substrate antenna system comprising: a first substrate comprising a planar antenna, the first substrate configured to be attached perpendicularly to a second substrate; and a second substrate connected perpendicularly to the first substrate.

In Example 33, the subject matter of Example 32 optionally includes wherein: the first substrate comprises a dielectric having two parallel sides; the planar antenna is located on a first of the two parallel sides of the dielectric; a feed port for the antenna is located adjacent the dielectric; and a feedline is attached to and located on a second of the parallel sides of the dielectric, the feedline integral with the feed port.

In Example 34, the subject matter can include, or can optionally be combined with any portion or combination of, any portions of any one or more of Examples 1 through 33 to include, subject matter that can include means for performing any one or more of the functions of Examples 1 through 33, or a machine-readable medium including instructions that, when performed by a machine, cause the machine to perform any one or more of the functions of Examples 1 through 33.

What is claimed is:

1. A planar antenna comprising:

a first substrate comprising a dielectric having two parallel sides;

a planar antenna formed on a first of the two parallel sides of the dielectric; and a feed port for the antenna, the feed port located adjacent the dielectric, wherein a plane of the planar antenna is configured for perpendicular attachment to a second substrate and the feed port includes a first part perpendicular to the planar antenna.

2. The planar antenna of claim 1 further comprising:

a feedline on a second of the two parallel sides of the dielectric, the feedline integral with the feed port.

3. The planar antenna of claim 2, further comprising a positive terminal and a negative terminal for the planar antenna, wherein the positive terminal and the negative terminal are connected to the feedline by a via.

4. The planar antenna of claim 2, wherein the feedline is plated on a copper film, the copper film comprising part of a core carrier.

5. The planar antenna of claim 2, further comprising a via extending between the planar antenna and the feedline.

6. The planar antenna of claim 1, wherein the feed port is located perpendicular to the two parallel sides of the dielectric.

7. The planar antenna of claim 1 wherein the dielectric substrate has no interior conductive layer parallel to the two parallel sides.

8. A substrate-on-substrate planar antenna system comprising:

a first substrate comprising a dielectric having two parallel sides, and a planar antenna is located on a first of the two parallel sides of the dielectric, wherein the first substrate is configured to be attached perpendicularly to a second substrate;

a second substrate connected perpendicularly to the first substrate; and a feedline located on a second of the two parallel sides of the dielectric.

9. The substrate-on-substrate planar antenna system of claim 8, wherein:

a feed port for the antenna is located adjacent the dielectric; and the feedline extends from the feed port.

10. The substrate-on-substrate planar antenna system of claim 9 wherein the feed port is integral with the feed line and is located perpendicular to the first of the two parallel sides of the dielectric.

11. The substrate-on-substrate planar antenna system of claim 9 further comprising a positive terminal and a negative terminal for the planar antenna, wherein the positive terminal and the negative terminal are connected to the feedline by a via.

12. The substrate-on-substrate planar antenna system of claim 9 wherein the feedline is plated on a copper film, the copper film comprising part of a core carrier.

13. The substrate-on-substrate planar antenna system of claim 8 wherein the second substrate has no interior conductive layer parallel to the two parallel sides.

14. A package-on-package planar antenna system comprising:

a first substrate that includes a first passive computer processor component or a first active computer processor component;

a second substrate that includes a second passive computer processor component or a second active computer processor component, the second substrate parallel to the first substrate;

a radio frequency front end (RFFE) located between the first substrate and the second substrate; and a plurality of substrate-on-substrate planar antenna systems connected perpendicularly to the first substrate and to the second substrate.

15. The package-on-package antenna system of claim 14 wherein at least one of the plurality of substrate-on-substrate planar antenna systems comprises:

a third substrate connected perpendicularly to the first substrate, the third substrate comprising a planar antenna; and a fourth substrate connected perpendicularly to the second substrate, the fourth substrate configured to shield the planar antenna from electromagnetic interference (EMI) caused by the RFFE.

16. The package-on-package antenna system of claim 15 herein, the third substrate comprises a dielectric having two parallel sides;

the planar antenna is located on a first of the two parallel sides of the dielectric;

a feed port for the antenna is located adjacent the dielectric; and a feedline from the feed port is located on a second of the two parallel sides of the dielectric.

17. The package-on-package antenna system of claim 16 wherein the planar antenna is attached to and located perpendicular to each of the first substrate and the second substrate.

18. The package-on-package antenna system of claim 16 further comprising a positive terminal and a negative terminal for the planar antenna, wherein the positive terminal and the negative terminal are connected to the feedline.

19. The package-on-package antenna system of claim 16 wherein the feedline is plated on a copper film, the copper film comprising part of a core carrier.

20. The package-on-package antenna system of claim 16 wherein the third substrate has no interior conductive layer parallel to the two parallel sides.

21. A method of forming a planar antenna on a first substrate comprising:

forming an antenna feedline on a conductive layer of a carrier;

forming a dielectric on the conductive layer, the dielectric having two parallel sides;

forming a planar antenna on a first of the two parallel sides of the dielectric; and forming a feed port adjacent the dielectric, wherein a plane of the planar antenna is configured for perpendicular attachment to a second substrate and the feed port is connected to the planar antenna by the feedline, wherein the antenna feedline is connected to the planar antenna by a via through solely the dielectric.

22. The method of claim 21 wherein the dielectric is a single layer of dielectric.

23. The method of claim 21 wherein one side of the feed port is located perpendicular to the two parallel sides of the dielectric.

24. The method of claim 21 further comprising forming a positive terminal and a negative terminal for the planar antenna, wherein the positive terminal and the negative terminal comprise the via.

25. The method of claim 21 wherein forming the feedline on a first conductive layer and forming the planar antenna on the dielectric are performed using a photolithographic process.

26. The method of claim 21 wherein the dielectric has no interior conductive layer parallel to the two parallel sides.

27. The method of claim 21 wherein the carrier comprises a core that is removable from the conductive layer, the method further comprising removing the core from the conductive layer.

28. The method of claim 27 further comprising etching the conductive layer to produce the first substrate.

29. A method of forming a substrate-on-substrate antenna system, comprising:

forming a first substrate comprising a planar antenna formed on a dielectric, the first substrate configured for perpendicular attachment to a second substrate;

attaching the first substrate to the second substrate in a perpendicular configuration;

forming an antenna feedline on a conductive layer of a carrier, the carrier comprising part of a core that is removable from the conductive layer;

forming a dielectric on the feedline, the dielectric having two parallel sides;

forming a planar antenna on a first of the two parallel sides of the dielectric; and forming a feed port adjacent the dielectric, wherein a plane of the planar antenna is configured for perpendicular attachment to the second substrate and the teed port is connected to the planar antenna by the feedline.

30. The method of claim 29 further comprising:

removing the core from the conductive layer; and etching the conductive layer to produce the first substrate.

31. A computer processor comprising:

one or more processor cores;

memory; and a memory controller, wherein the one or more of the processor cores, memory, or memory controller includes:

a substrate-on-substrate antenna system comprising:

a first substrate comprising a planar antenna, the first substrate configured to be attached perpendicularly to a second substrate; and a second substrate connected perpendicularly to the first substrate.

32. The computer processor of claim 31 wherein:

the first substrate comprises a dielectric having two parallel sides;

the planar antenna is located on a first of the two parallel sides of the dielectric;

a feed port for the antenna is located adjacent the dielectric; and a feedline is attached to and located on a second of the parallel sides of the dielectric, the feedline integral with the feed port.

* * * * *